United States Patent [19]

Oba

[11] Patent Number: 4,815,878

[45] Date of Patent: Mar. 28, 1989

[54] PRINTING APPARATUS AND A PAPER CONTROLLING METHOD FOR A PRINTER WHEREIN PAPER SLACK IS CANCELLED

[75] Inventor: Ryozo Oba, Shizuoka, Japan

[73] Assignee: Tokyo Electric Co., Ltd., Tokyo, Japan

[21] Appl. No.: 80,211

[22] Filed: Jul. 31, 1987

Related U.S. Application Data

[63] Continuation of Ser. No. 812,896, Dec. 23, 1985, abandoned.

[30] Foreign Application Priority Data

Dec. 24, 1984 [JP] Japan ..... 59-272493

[51] Int. Cl.[4] ..... B41J 11/28

[52] U.S. Cl. ..... 400/616.3; 400/577; 400/618; 226/76

[58] Field of Search ..... 400/551, 577, 583, 611, 400/616, 616.1, 616.2, 616.3, 618, 620; 226/76

[56] References Cited

U.S. PATENT DOCUMENTS

| | | | |
|---|---|---|---|
| 2,293,769 | 8/1942 | Sherman | 400/616.3 X |
| 2,311,051 | 2/1943 | Hope, Jr. | 400/616.3 X |
| 2,858,004 | 10/1958 | Febvre | 400/616.3 X |
| 3,749,221 | 7/1973 | Busch | 400/620 |
| 3,949,856 | 4/1976 | Ulber et al. | 400/616.3 X |
| 4,000,803 | 1/1977 | Warp et al. | 400/616.3 |
| 4,005,810 | 2/1977 | Porter | 400/616.3 X |
| 4,074,067 | 2/1978 | Speckhard | 400/551 X |
| 4,164,376 | 8/1979 | Yarp | 400/616.2 X |
| 4,175,687 | 11/1979 | Kenworthy | 400/551 X |
| 4,195,940 | 4/1980 | Rekewitz | 400/616.3 X |
| 4,234,261 | 11/1980 | Hendrischk et al. | 400/551 X |
| 4,269,532 | 5/1981 | Levinson et al. | 400/616.1 |
| 4,405,248 | 9/1983 | Wunderlich et al. | 400/551 X |

FOREIGN PATENT DOCUMENTS

| | | | |
|---|---|---|---|
| 0099957 | 2/1984 | European Pat. Off. . | |
| 0151425 | 8/1985 | European Pat. Off. | 400/577 |
| 2260689 | 6/1973 | Fed. Rep. of Germany . | |
| 3225231 | 1/1983 | Fed. Rep. of Germany | 400/616.1 |
| 0093181 | 6/1982 | Japan | 400/616.1 |
| 0156286 | 9/1982 | Japan | 400/616.1 |
| 0055774 | 3/1984 | Japan | 400/551 |
| 0176064 | 10/1984 | Japan | 400/551 |
| 0018376 | 1/1985 | Japan | 400/551 |
| 0031983 | 2/1985 | Japan | 400/577 |
| 84/00324 | of 1984 | World Int. Prop. O. . | |

OTHER PUBLICATIONS

IBM Technical Disclosure Bulletin, "Compensation for Gear and Stepper Motor Errors", vol. 28, No. 10, Mar. 1986, pp. 4354–4355.

IBM Technical Disclosure Bulletin, "Print View and Return Device", Blaskovic et al., vol. 24, No. 1A, Jun. 1981, pp. 395–397.

*Primary Examiner*—Ernest T. Wright, Jr.

*Attorney, Agent, or Firm*—Oblon, Fisher, Spivak, McClelland & Maier

[57] ABSTRACT

A printing apparatus and a paper controlling method for a printer in which, upon activating a power source or upon changing over to the on-line mode or upon switching to a high paper feed speed, a paper feed motor is rotated first reversely to draw back paper by an amount a little greater than an amount of a possible slack and then forwardly to advance the paper. Accordingly, paper slack can be cancelled adjacent a print head in preparation for subsequent printing. Accordingly, high quality printing can be attained.

5 Claims, 5 Drawing Sheets

PRINTING APPARATUS AND A PAPER CONTROLLING METHOD FOR A PRINTER WHEREIN PAPER SLACK IS CANCELLED

This application is a continuation of application Ser. No. 812,896, filed on Dec. 23, 1985, now abandoned.

FIELD OF THE INVENTION AND RELATED ART STATEMENT

This invention relates to a paper controlling method for a printer wherein a continuous paper web is fed by means of a tractor.

Conventionally, in a printer of this type, even if there is a slack in a paper web upon activating a power source, after paper feeding or after replacement of paper, the printer is used with such a slack left as it is.

However, in recent years, high quality printing is required for printers, and to this end, 2 pass printing is performed frequently. The 2 pass printing is a method of printing a character by operating each dot print element twice before and after feeding of paper by a minute amount. According to the 2 pass printing, where a print head which can print, for example, 9 dots in a vertical direction, that is, in a column, a line is first printed with such 9 dots for each column and then paper is fed by a distance corresponding to one half of the pitch of the dots whereafter another line is printed again with 9 dots for each column, thereby completing a print line. For example, where the dot pitch in each column is 0.36 mm and the line space is 1/6 inch, paper will be fed firstly by 1/6 inch and secondly by 0.18 mm. In the 2 pass printing, it is necessary to assure smooth paper feeding in order to fully attain the characteristics of the method. Conventionally, however, the print quality is bad with the first print line after activating a power source or after setting of paper, and slackening of paper is one of most significant causes of the problem.

OBJECT AND SUMMARY OF THE INVENTION

It is an object of the present invention to provide a paper controlling method for a printer which can eliminate slackening of paper after activating a power source or after setting of paper to improve the print quality thereof.

According to the invention, in order to resolve the problem, upon activating a power source and upon changing over to the on-line mode, a paper feed motor is rotated first reversely to draw back paper by an amount a little greater than the amount of a possible slack, and then is rotated forwardly to advance the paper.

DETAILED DESCRIPTION OF THE PREFERRED EMBODIMENT

Figure 1:
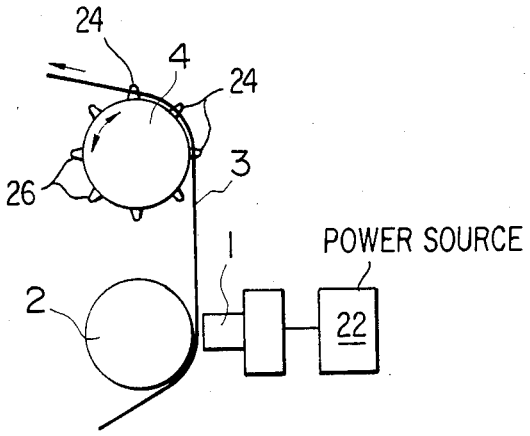
FIG. 1 is a schematic side elevational view of a printing mechanism.
Figure 2:
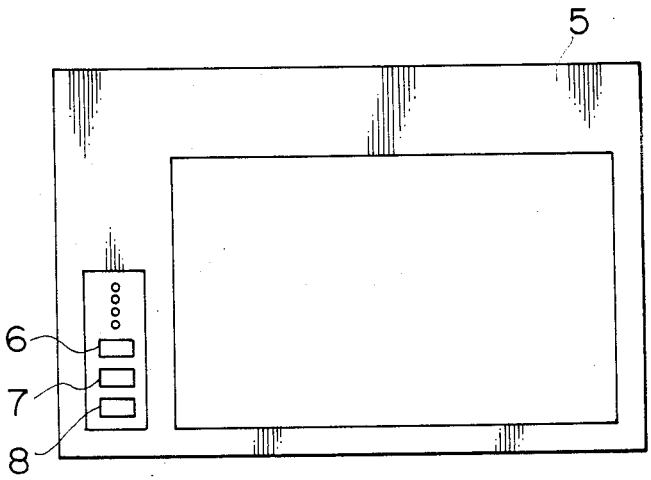
FIG. 2 is a plan view of a printer.
Figure 3:
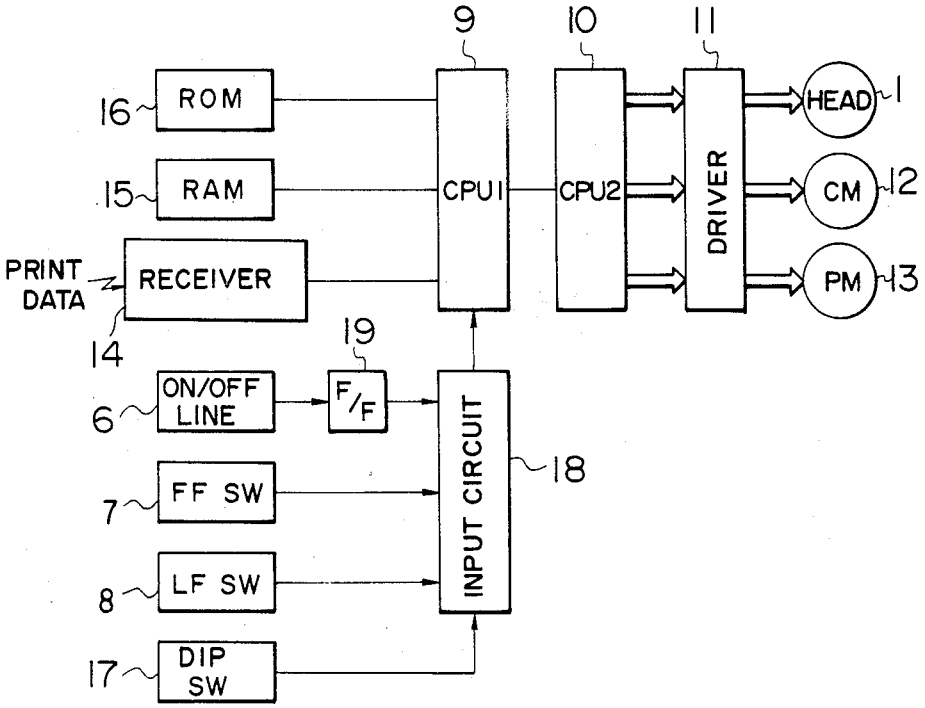
FIG. 3 is a block diagram.

An embodiment of the present invention will be described below with reference to the drawings. Referring first to FIG. 1 which illustrates a general construction of a printer, the printer basically includes a print head 1 and a platen roller 2 between which a continuous paper web 3 for printing is fed by means of a tractor 4, and a power source 22. Referring now to FIG. 2 which illustrates a plan view of the printer, an on-line/off-line change-over switch 6, a form feed switch 7, and a line feed switch 8 are located on an upper face of a printer body 5. Referring further to FIG. 3 which illustrates a control system of the printer, the control system basically includes a central processing unit (CPU1) 9 on the master side and a second central processing unit (CPU2) 10 on the slave side. The CPU1 9 involves reception and editing of print data, production of test data, reading of various switches and processing of such data, and delivers print codes converted into dot patterns to the CPU2 10. A feed command is also delivered to the CPU2 10. Meanwhile, the CPU2 10 operates under control of the CPU1 9 and drives the print head 1, a carrier motor 12 and a paper feed motor 13 via a driver 11. The CPU1 9 stores data received by way of a receiver circuit 14 in a RAM 15 connected thereto. RAM 15 functions as a reception buffer or a print buffer for CPU1 9. In this instance, when requirements for printing are met, the CPU1 9 controls the CPU2 10 to operate the carrier motor 12 and delivers dot pattern data to the CPU2 10. The CPU2 10 then drives the print head 1 to effect printing in response to the dot pattern data delivered thereto. After completion of required printing, the paper feed motor 13 is driven to effect required paper feeding. As an additional function, conditions of a dip switch 17 are read upon activating the power source 22. On the other hand, the on-line/off-line change-over switch 6, the form feed switch 7 and the line feed switch 8 are read principally to effect feeding operations or changing over operations between on-line and off-line conditions and so on when printing is not performed. Those inputs are all read by the CPU1 9 by way of an input circuit 18. Reference numeral 16 denotes a ROM, and 19 a flipflop.

Figure 4A:
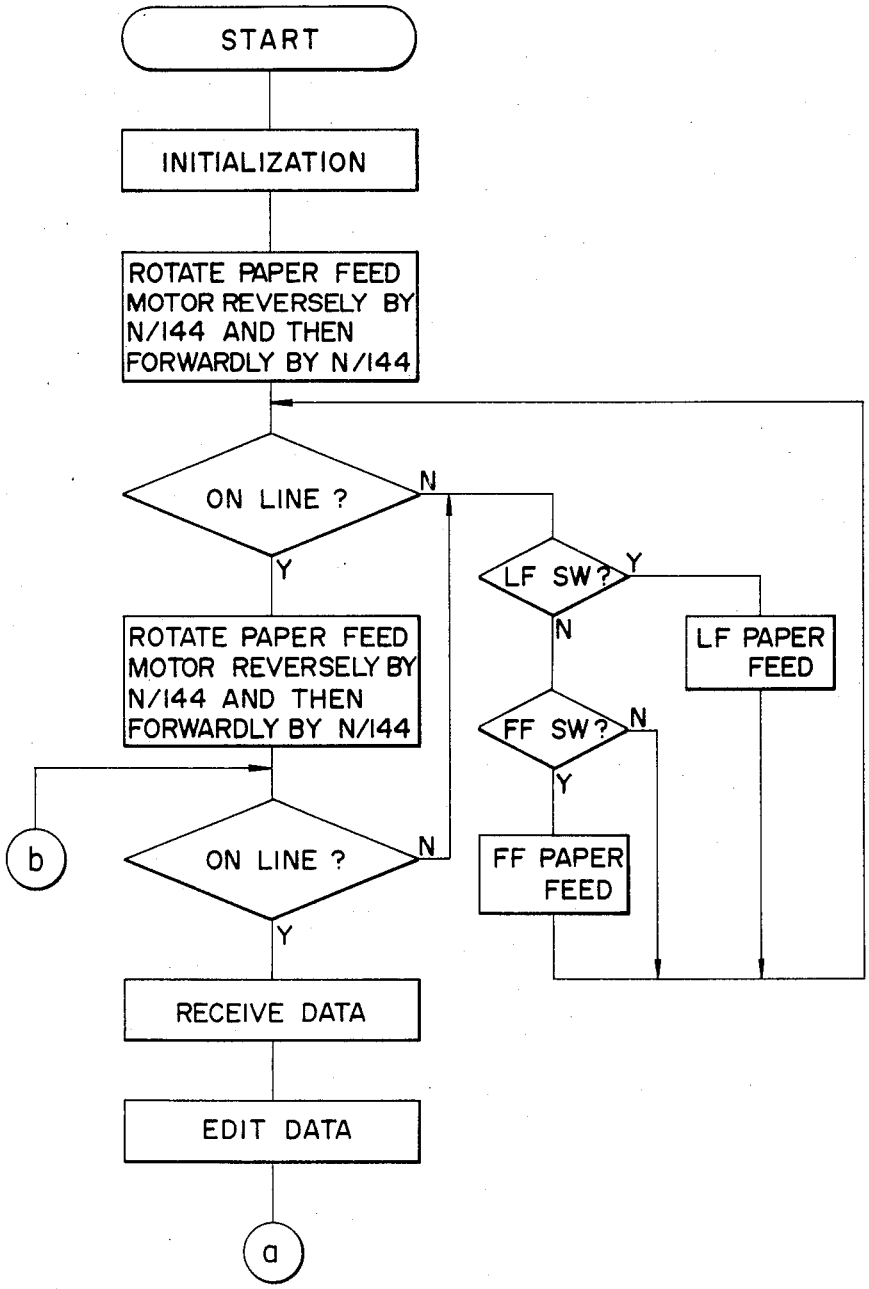
FIGS. 4(A) and 4(B) are flow charts.
Figure 4:
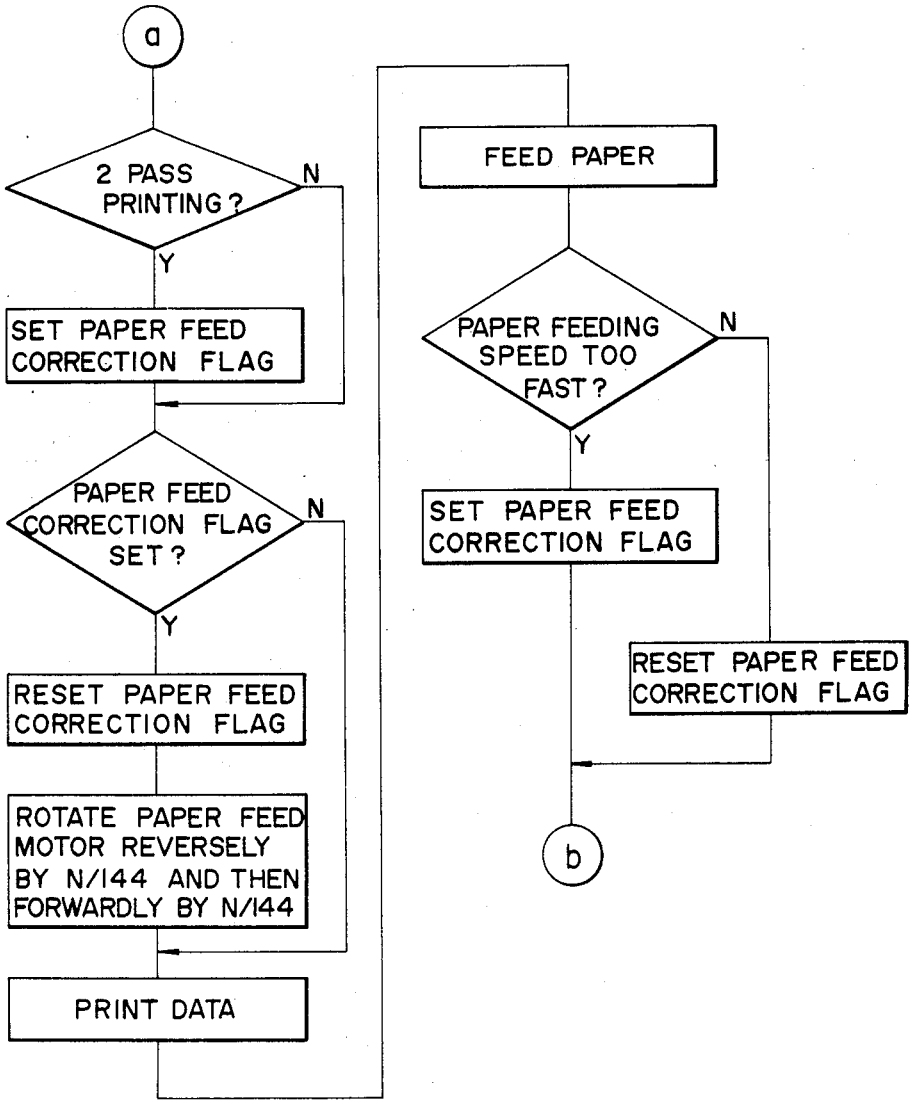
Figure 5:
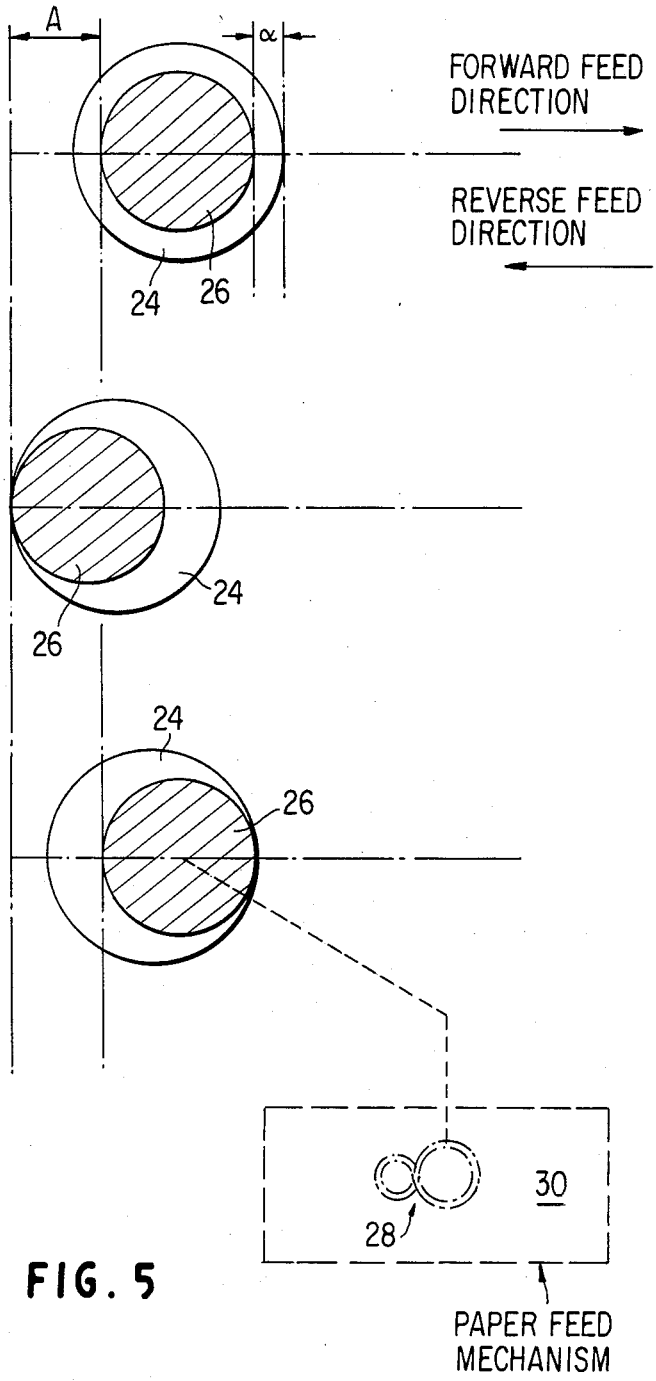
FIG. 5 is a schematic block diagram illustrating the paper feed operation according to the invention.

Characteristics of the present invention will now be described with reference to a flow chart illustrated in FIGS. 4(A) and 4(B). At first, the entire system is initialized. Here, the RAM 15 is cleared and inputs such as the dip switch 17 are read for initialization. Then, initial operations are performed, and the print head 1 is returned to its home position to prepare for subsequent printing thereby. And then, paper feeding which is one of the characteristics of the present invention is performed. Thus, the paper feed motor 13 is rotated at first reversely by an amount A, as shown in FIG. 5, corresponding to N/144 pulses to draw back paper 3 a little amount and then forwardly by the same amount, that is, an amount corresponding to N/144 pulses. Here, the distance between adjacent dot print elements on the print head 1 is 1/72 inch, and in the case of the 2 pass printing, the paper 3 is fed by 1/144 inch (about 0.18 mm). The N/144 pulses (inches) correspond to a feed amount A corresponding to the height of one character. By such reverse and subsequent forward rotations of the paper feed motor 13, slack $\alpha$, also shown in FIG. 5, of the paper 3 can be absorbed or cancelled. In this regard, where the maximum amount of slack which can possibly appear between the print head 1 and the tractor 4 is $\alpha$, and the paper 3 is to be drawn back by a predetermined amount, A, where $A>\alpha$, when the paper 3 is drawn back by the amount A by reverse rotation of the paper feed motor 13 to rotate the tractor 4 in a reverse direction, the slack $\alpha$ in the paper will be taken up by paper feeding in the following forward rotation of the motor 13. In particular, the paper 3 has rigidity to some degree, and hence if there is a slack $\alpha$ of the paper 3, the paper 3 will be drawn back with the slack $\alpha$ maintained. As a result, upon subsequent forward rotation of the paper feed motor 13, the remaining slack $\alpha$ of the paper 3 is taken up. By locating the tractor 4 above the location of the print head 1 opposed to the platen roller 2, as shown in FIG. 1, the weight of the paper 3 exerts a force acting downwardly from the tractor 4 to the print head 1 to facilitate taking up slack in the paper 3. Besides, an end of the paper 3 will not come out of position. After completion of the treatment of the paper 3 upon activating the power source 22, the mode is checked to see if the system is in the on-line mode or in the off-line mode. If the system is in the off-line mode, conditions of the line feed switch 8 and the form feed switch 7 are checked, and when either one of the switches 8 and 7 is or has been depressed, either line feeding (LF) or form feeding (FF) is carried out. Now, if it is assumed that line feeding is carried out, there is the possibility that the paper 3 will be re-set manually since the system is in the off-line mode. Thus, also when the on-line mode is entered after such possible paper setting while in the off-line mode, the same paper feeding operation for taking up possible slackening of the paper 3 as described above is carried out. In particular, the paper feed motor 13 is rotated first reversely by an amount corresponding to N/144 pulses to draw back the paper 3 a little amount and then forwardly by the same amount corresponding to N/144 pulses. In this way, also just after changing over from the off-line mode to the on-line mode, reverse and then forward rotations of the paper feed motor 13 are carried out to take up a possible slack $\alpha$ in the paper 3. Then, when the system is in the on-line mode, reception and editing of data are effected, and then it is checked to see if 2 pass printing is to be effected.

Here, if 2 pass printing is to be effected, a paper feed correction flag is set. Then, if the paper feed correction flag is in the set condition, the paper feed correction flag is reset, and then the paper feed motor 13 is rotated first reversely by an amount corresponding to N/144 pulses to draw back the paper 3 a little amount and then forwardly by the same amount corresponding to N/144 pulses. Then, data printing is effected. If the paper feed correction flag is otherwise not in the set condition, data printing is effected subsequently without carrying out such operations as described above.

Subsequently, paper feeding is effected. But this paper feeding involves two different feeding speeds, and when paper 3 is to be fed at a higher speed, the paper feed correction flag is set, but on the contrary when paper 3 is to be fed at a lower speed, the paper feed correction flag is not set. Such setting of the paper feed correction flag when paper 3 is to be fed at a higher speed is intended to prevent possible slackening of the record paper 3 caused by an influence of a back-lash at meshing portions of gear wheels 28 of a paper feed mechanism 30, as schematically shown in FIG. 5, or by errors between perforations 24 of the record paper 3 and pins 26 of the tractor 4. In particular, since there exists a back-lash at meshing portions of gear wheels 28 of a paper feed mechanism 30, as schematically shown in FIG. 5, upon paper feeding at a higher speed, the record paper 3 may move excessively by an amount corresponding to the back-lash in the paper feeding direction due to the inertia of the associated parts of the paper feed mechanism 30, resulting in slackening of the paper 3. Fitting errors between perforations 24 in paper 3 and pins 26 of the tractor 4 will also cause slackening in the paper 3. Thus, in order to cancel such possible slackening of paper 3 where the paper feeding speed is high, the paper feed correction flag is set so that the paper feed motor 13 may be rotated first reversely by an amount corresponding to N/144 pulses to draw back the paper 3 a little amount A and then forwardly by the same amount A corresponding to N/144 pulses.

In this manner, according to the embodiment of the present invention, upon activating the power source 22 before initiation of actual printing or upon changing over to the on-line mode, the paper feed motor 13 is rotated first reversely and then forwardly to take up possible slackening of the paper 3. Accordingly, in case of the 2 pass printing, high quality printing can be attained from the first print line. However, accuracy in paper feeding will be improved also for printing other than the 2 pass printing. Further, since the paper feed motor 13 operates upon activating a power source 22, operation of the paper feed motor 13 can be checked from this initial operation of the same.

It is to be noted that while description has been given of the embodiment in connection with 2 pass printing, the method of the present invention can be actually applied also to n pass printing involving n feeding operations for printing a print line.

As apparent from the foregoing description, according to the present invention, upon activating a power source 22 or upon changing over to the on-line mode, a paper feed motor 13 is rotated first reversely by a predetermined amount to draw back paper 3 and then forwardly by the same amount to advance the paper 3 in preparation for subsequent printing. Accordingly, when printing is to be initiated, paper 3 is ready without a slack $\alpha$, and hence in case of the 2 pass printing, high quality printing can be attained from the first print line.

What is claimed is:

1. In a paper controlling method for a printer of the type wherein a continuous paper web on which a print head opposed to a platen prints is fed by means of a tractor to effect n pass printing said paper web having paper web holes engaged by pins of said tractor, the improvement wherein said tractor is located downstream along the paper web in a forward feed direction away from said print head opposed to said platen and before printing and upon activating a power source, a paper feed motor is rotated first reversely by a distance (A) a little greater than an amount of possible slackening ($\alpha$) of the paper web which can possibly appear between said print head and said tractor to draw back the paper web, and then forwardly by the same distance (A) to advance the paper web so as to close gaps in said forward feed direction between said tractor pins and paper web holes, said tractor being located above the location of said print head opposed to said platen, so that the weight of the paper exerts a force acting downwardly from the tractor towards the print head, wherein reverse rotation of said motor followed by forward rotation of the motor relocates the pins of said tractor relative to the holes of said paper so that a line spacing distance in the forward feed direction is constant.

2. In a paper controlling method for a printer of the type wherein a continuous paper web on which a print head opposed to a platen prints is fed by means of a tractor to effect n pass printing, said paper web having paper web holes engaged by pins of said tractor, the improvement wherein said tractor is located downstream along the paper web in a forward feed direction away from said print head opposed to said platen and, before printing and upon changing to an on-line mode, a paper feed motor is rotated first reversely by a distance (A) a little greater than an amount of possible slackening ($\alpha$) of the paper web which can possibly appear between said print head and said tractor to draw back the paper web, and then forwardly by the same distance (A) to advance the paper web so as to close gaps in said forward feed direction between said tractor pins and paper web holes, said tractor being located above the location of said print head opposed to said platen, so that the weight of the paper exerts a force acting downwardly from the tractor towards the print head, wherein reverse rotation of said motor followed by forward rotation of the motor relocates the pins of said tractor relative to the holes of said paper so that a line spacing distance in the forward feed direction is constant.

3. In a paper controlling method for a printer of the type wherein a continuous paper web on which a print head opposed to a platen prints is fed by means of a tractor to effect n pass printing, said paper web having paper web holes engaged by pins of said tractor, the improvement wherein said tractor is located downstream along the paper web in a forward feed direction away from said print head opposed to said platen and, before printing and when the paper is to be fed at a high speed, a paper-feed motor is rotated first reversely by a distance (A) a little greater than an amount of possible slackening ($\alpha$) of the paper web which can possible appear between said print head and said tractor to draw back the paper web, and then forwardly by the same distance (A) to advance the paper web so as to close gaps in said forward feed direction between said tractor pins and paper web holes, said tractor being located above the location of said print head opposed to said platen, so that the weight of the paper exerts a force acting downwardly from the tractor towards the print head, wherein reverse rotation of said motor followed by forward rotation of the motor relocates the pins of said tractor relative to the holes of said paper so that a line spacing distance in the forward feed direction is constant.

4. An apparatus for n pass printing on a continuous paper web having holes provided at regular intervals at opposed sides of said web, comprising:

a tractor having plural pins for engaging the holes of said paper web;

a print head opposed to a platen for printing symbols on said paper web;

motor means for rotating said tractor forwardly in a first direction so that the paper web is advanced to said print head and reversely in a second direction opposite to said first direction, wherein said tractor is located downstream along the paper web in a forward feed direction away from said print head opposed to said platen; and control means for controlling operation of said motor means so that before printing and upon occurrence of at least one of an activation of a power source, changing to an on-line mode and a changing to high speed printing, said motor means rotates said tractor first reversely by a distance (A) a little greater than an amount ($\alpha$) of possible slackening of the paper web to draw back the paper web, and then forwardly by the same distance (A) to advance the paper web, wherein the reverse rotation of the tractor followed by forward rotation of the tractor prior to printing closes gaps in the first direction between said tractor pins and said paper web holes and removes any slack in said paper web adjacent said print head, said tractor being located above the location of said print head opposed to said platen, so that the weight of the paper exerts a force acting downwardly from the tractor towards the print head, wherein reverse rotation of said motor followed by forward rotation of the motor relocates the pins of said tractor relative to the holes of said paper so that a line spacing distance in the forward feed direction is constant.

5. An apparatus according to claim 1, comprising:

a platen around which said paper web passes upon being advanced from a paper supply to said tractor.

* * * * *